US005992843A

United States Patent [19]

Lee

[11] Patent Number: 5,992,843

[45] Date of Patent: Nov. 30, 1999

[54] APPARATUS FOR PREVENTING A SHEET OF DOG-EARED FEED PAPER FOR A PRINTING EQUIPMENT

[75] Inventor: Yong-hyun Lee, Kyungki-do, Rep. of Korea

[73] Assignee: Samsung Electronics Co., Ltd., Rep. of Korea

[21] Appl. No.: 08/770,787

[22] Filed: Dec. 20, 1996

[30] Foreign Application Priority Data

Dec. 20, 1995 [KR] Rep. of Korea ..... 95-44480 U

[51] Int. Cl.[6] ..... B65H 3/54

[52] U.S. Cl. ..... 271/170; 271/167; 271/169

[58] Field of Search ..... 271/170, 167, 271/169

[56] References Cited

U.S. PATENT DOCUMENTS

| | | | |
|---|---|---|---|
| 4,429,865 | 2/1984 | Okada | 271/170 |
| 4,595,191 | 6/1986 | Uchiyama et al. | 271/170 |
| 5,120,040 | 6/1992 | Worley | 271/167 X |

FOREIGN PATENT DOCUMENTS

| | | | |
|---|---|---|---|
| 228341 | 11/1985 | Japan | 271/169 |
| 140239 | 5/1992 | Japan | 271/170 |
| 292344 | 10/1992 | Japan | 271/170 |

*Primary Examiner*—William E. Terrell
*Assistant Examiner*—Patrick Mackey
*Attorney, Agent, or Firm*—Banner & Witcoff, Ltd.

[57] ABSTRACT

An apparatus in an automatic sheet feeder for a printer, a copy machine, or the like that prevents a corner of a sheet of feed paper from being turned down or "dog-eared" when that sheet of feed paper is being advanced from a stack of the feed paper. The apparatus includes a resilient finger engaging the forward edge of the sheet of feed paper. The resilient finger deflects slightly when the sheet of feed paper is urged forward such that the corner of the sheet of feed paper advances past the finger without folding or becoming dog-eared and the sheet of feed paper is separated from the stack of paper. In a preferred embodiment, the resilient finger is pivotally secured to a cassette for holding the stack of paper, and the finger is biased to engage the top most sheet of the stack of feed paper.

8 Claims, 2 Drawing Sheets

APPARATUS FOR PREVENTING A SHEET OF DOG-EARED FEED PAPER FOR A PRINTING EQUIPMENT

BACKGROUND OF THE INVENTION

1. Field of the Invention

The present invention relates to an automatic sheet feeding apparatus applied to a printer, a copy machine and a printing equipment having the similar function as such, and more particularly to an apparatus capable of preventing a corner of a sheet of feed paper from being turned down.

2. Description of the Prior Art

Generally, a printing equipment is furnished with an automatic sheet feeder for automatically feeding sheets of paper and a sheet supply device for preventing overlapping feed of supplied sheets of paper.

Typically, the sheet supply device is constructed such that a finger for deterring leading edges of stacked sheets of paper are fixedly installed to both leading edges of a cassette which stores by being loaded with the sheets of paper. Thus, the sheet of paper supplied by a pickup roller is deterred to be held by the finger, thereby solely feeding the sheet of paper at the top of the stacked sheets of paper. The conventional sheet supply device can slightly accomplish the purpose of supplying a single sheet of paper by the fixedly-installed finger. However, the finger is fixedly installed to be disadvantageous in that the corner of the sheet deterred by the finger is folded, i.e. dog-ear occurs. Additionally, the conventional finger structure is for simply preventing the overlapping feed by the binding force of the supplied sheet of paper and the finger. Thus, if the binding force is intensified, the sheet of paper is jammed to cause a misfeeding which inhibits the paper feeding. The misfeeding more frequently appears as the thicker sheet of paper is supplied. In order to solve this problem, a sheet supply device capable of moving the finger has been suggested, which will be described with reference to accompanying drawings as below.

As shown in FIG. 1, a shaft 203 is formed to project from one side of a cassette 100, and an orifice 201 inserted with shaft 203 is formed in the body of a finger 200. Then, a return spring 205 is flexibly installed to the rear end of the body.

According to the conventional sheet supply device constructed as above, a sheet of paper fed by a pickup roller 101 is caught at the leading edges of finger 200 to bend the upper corner thereof. Thereafter, the leading edge of the paper pushes finger 200 by the bending motion, and orifice 201 formed in the body of finger 200 is guided by shaft 203 to advance finger 200. Then, stacked sheets of paper 102 is supplied one by one, and advanced finger 200 returns to the original position by return spring 205, thereby preparing the succeeding operation.

However, the conventional sheet supply device involves drawbacks that so much resistance is imposed upon the advancing and retreating motions of finger 200 to impede a smooth operation. Also, finger 200 is formed of an iron substance identical to those of typical fingers to retain no intrinsic elasticity with the consequence of making it impossible to perfectly solve the problem of the turning down the corner of a sheet of feed paper.

SUMMARY OF THE INVENTION

Therefore, the present invention is devised to solve the foregoing problems. It is an object of the present invention to provide an apparatus for preventing a sheet of dog-eared feed paper, wherein a finger is formed of a plastic resin substance retaining an intrinsic elasticity, and the finger becomes put aside to one side by an advancing motion of a sheet of paper to carry out the operation of individually supplying a sheet of paper.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENT

An apparatus for preventing a sheet of dog-eared feed paper according to the present invention will be described in detail with reference to FIGS. 2 and 3.

Figure 1:
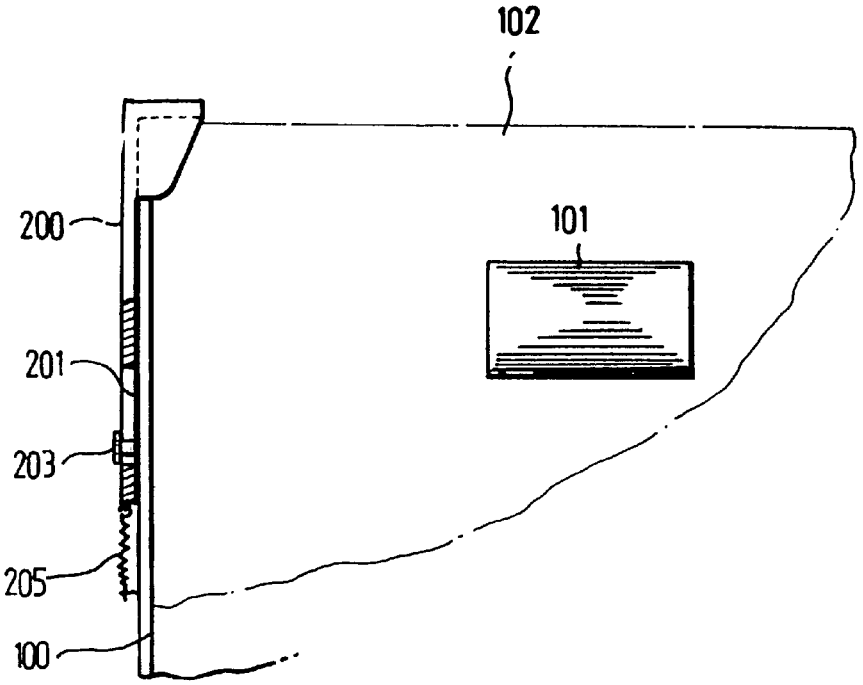
FIG. 1 (PRIOR ART)
FIG. 1 is a plan view showing a conventional technique.
Figure 2:
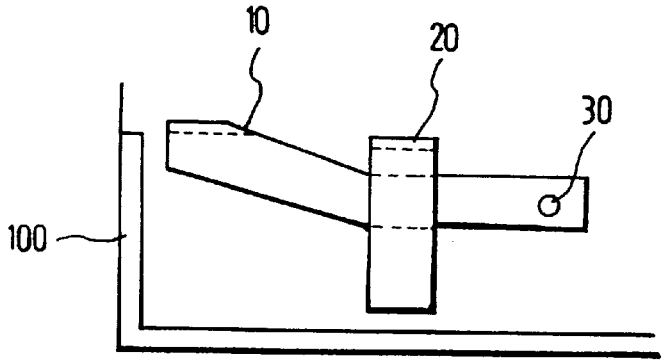
FIG. 2 is a side view showing an apparatus for preventing a sheet of dog-eared feed paper according to the present invention.
Figure 3:
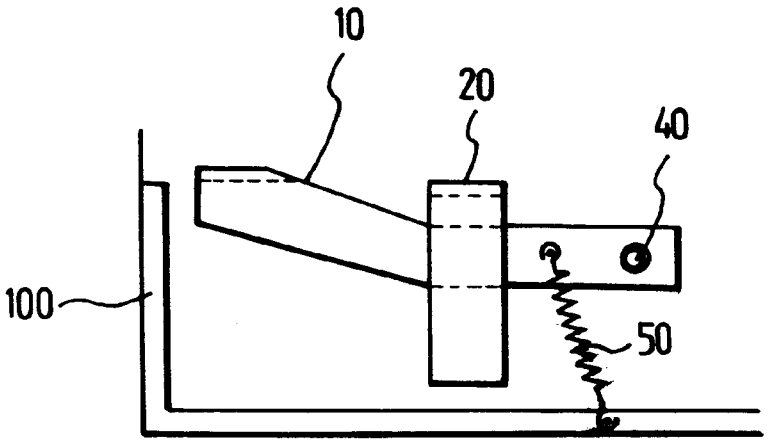
FIG. 3 is a side view showing another embodiment of the apparatus for preventing a sheet of dog-eared feed paper according to the present invention.

As shown in FIG. 2, the end of a finger 10 having an intrinsic elasticity is fixedly installed to one side of a cassette 100 which stores to be loaded with sheets of paper, and a guide 20 connected to be coupled to the side plane of cassette 100 is placed to the outer side of finger 10, thereby deterring the deviation of finger 10. Preferably, finger 10 is formed of a plastic resin substance having an excellent intrinsic elasticity. In the first embodiment shown in FIG. 1, finger 10 is rigidly secured to cassette 100 at fixing shaft 30. In the second preferred embodiment shown in FIG. 2, finger 10 and cassette 100 are connected to be coupled with each other by means of a ball shaft 40 shaped as a ball, and a return spring 50 is flexibly installed to finger 10.

According to the present invention constructed as above, while the leading edge of a sheet of paper 102 fed by means of the frictional force of an advancing device such as pickup roller 101 is deterred by the leading edge of finger 10, the paper sheet at the top of the paper stack is separated. Successively, sheet of paper 102 is advanced by the continuing rotative operation of pickup roller 101 to be supplied into the printing equipment while pushing out finger 10 to one side of cassette 100.

At this time, one end of finger 10 having the intrinsic elasticity is fixedly coupled to one side of cassette 100 is forced out by bending about a fixing shaft 30 to return to its original position by means of the intrinsic elasticity once sheet of paper 102 becomes free from finger 10, thereby preparing the succeeding operation.

At this time, the decisive idea of the present invention is the mass of intrinsic elasticity, or elastic modulus, of finger 10, which is preferably smaller (to be approximately 20 g to 25 g) than that (of approximately 30 g to 50 g) of forwardly feeding the sheet of paper 102 by pickup roller 101.

In order to more easily adjust the elasticity of finger 10, ball shaft 40 is interposed between one end of finger 10 and cassette 100 to connectively couple with each other, and return spring 50 is flexibly installed to finger 10 to adjust the elasticity of finger 10 by means of the repulsive force of return spring 50.

In the apparatus for preventing a sheet of dog-eared feed paper for the printing equipment according to the present invention, the separate sheet feed operation is performed while the finger is moved to one side even though the sheets of feed paper supplied to the leading edge of the finger strongly overlap with each other. As a result, the dog-ear of the paper sheet does not occur and, furthermore, the misfeeding of the automatic paper feeder can be inhibited.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. An apparatus for separating and advancing a sheet of feed paper from a stack of sheets of feed paper, the feed paper having a forward edge comprising:

a cassette for receiving the stack of sheets of feed paper;

an advancing device positioned to engage the stack of sheets of feed paper such that it urges the sheet of feed paper closest to the advancing device forward from the stack of sheets of feed paper;

a resilient finger, pivotally secured to said cassette by a ball shaft extending from said cassette, sized and positioned to engage the forward edge of the sheet of feed paper when the sheet of feed paper is positioned on the stack of feed paper, said finger being resilient enough to deflect when the sheet of feed paper is urged forward such that the forward edge of the sheet of feed paper disengages from the finger without becoming dog-eared and the sheet of feed paper is separated from the stack of paper, said finger biased to engage the stack of feed paper such that said finger pivots away from the stack of feed paper when the sheet of feed paper is urged forward by the advancing device and said finger returns to engage said stack of feed paper after said sheet of feed paper becomes disengaged from said finger.

2. The apparatus of claim 1, wherein the finger deflects in a direction away from a side edge of the sheet of feed paper when the sheet of feed paper is urged forward.

3. The apparatus of claim 1, wherein said finger is biased to engage the stack of feed paper by a spring extending between said cassette and said finger.

4. The apparatus of claim 1, wherein said resilient finger is constructed of plastic resin.

5. The apparatus of claim 1, wherein said resilient finger has an elastic modulus less than the mass of intrinsic elasticity of the sheet of feed paper being urged forward by the advancing device.

6. The apparatus of claim 5, wherein the elastic modulus for the finger is between 20 grams and 25 grams, inclusive.

7. The apparatus of claim 1, further including a guide secured to said cassette and engaging said finger to limit the range of pivotal movement of the finger.

8. The apparatus of claim 2, further including a guide secured to said cassette and engaging said finger to limit the amount of deflection of said finger in the direction away from a side edge of the sheet of feed paper.

* * * * *